US006834580B2

(12) United States Patent
Thomas

(10) Patent No.: US 6,834,580 B2
(45) Date of Patent: Dec. 28, 2004

(54) OFFSET PRESS WITH IMPROVED CYLINDER MOUNTING

(75) Inventor: Michel Thomas, La Chapelle sur Erdre (FR)

(73) Assignee: Goss Systemes Graphiques Nantes, Nantes (FR)

( * ) Notice: Subject to any disclaimer, the term of this patent is extended or adjusted under 35 U.S.C. 154(b) by 9 days.

(21) Appl. No.: 10/198,997

(22) Filed: Jul. 22, 2002

(65) Prior Publication Data

US 2003/0024420 A1 Feb. 6, 2003

(30) Foreign Application Priority Data

Jul. 23, 2001 (FR) ..... 01 09815

(51) Int. Cl.[7] ..... B30B 3/00; B41F 7/00; B41F 7/02

(52) U.S. Cl. ..... 100/158 R; 100/161; 100/176; 101/212; 101/216; 101/217; 101/153

(58) Field of Search ..... 100/155 R, 158 R, 100/161, 168, 172, 175, 176; 101/212, 216, 217, 218, 153

(56) References Cited

U.S. PATENT DOCUMENTS 3,732,813 A * 5/1973 Vir Singh et al. ..... 101/216
4,200,045 A * 4/1980 Toropainen ..... 101/217
4,351,237 A * 9/1982 Tappert et al. ..... 101/216
5,746,132 A * 5/1998 Parks et al. ..... 101/483
6,109,180 A * 8/2000 Guaraldi et al. ..... 101/466
6,314,881 B1 * 11/2001 Gotting ..... 101/216

FOREIGN PATENT DOCUMENTS

EP 0 686 502 12/1995

* cited by examiner

*Primary Examiner*—Allen Ostrager
*Assistant Examiner*—Shelley Self
(74) *Attorney, Agent, or Firm*—Marshall, Gerstein & Borun LLP

(57) ABSTRACT

The offset press comprises a frame, at least one plate cylinder, a press cylinder, and a blanket cylinder interposed between the plate cylinder and the press cylinder, together with bearing assemblies carried by the frame and receiving the longitudinal ends of the cylinders so that each cylinder is rotatable relative to the frame about a respective longitudinal central axis. Each of the longitudinal ends of at least a first cylinder are received in a first bearing assembly and a second bearing assembly, the second bearing assembly being spaced apart from the first bearing assembly along the longitudinal axis of the first cylinder.

6 Claims, 3 Drawing Sheets

OFFSET PRESS WITH IMPROVED CYLINDER MOUNTING

The invention relates to an offset press of the type comprising a frame, at least one plate cylinder, a press cylinder, and a blanket cylinder interposed between the plate cylinder and the press cylinder, and bearing assemblies carried by the frame and receiving the longitudinal ends of the cylinders so that each cylinder is free to rotate relative to the frame about a respective longitudinal central axis.

BACKGROUND OF THE INVENTION

In such a press, each cylinder end is mounted in a frame via a rotary bearing assembly. Drive means serve to set the cylinders into rotation.

In operation, the plate carried by the plate cylinder is moistened and then inked. The plate transfers ink from its printing regions onto the blanket carried by the blanket cylinder. The blanket then transfers ink onto the paper to be printed which passes between the blanket cylinder and the press cylinder.

In order to be able to transfer the ink firstly from the plate to the blanket and secondly from the blanket to the paper, the plate cylinder, the blanket cylinder, and the press cylinder must press against one another in operation. The cylinders then exert radial bending forces on one another.

In order to prevent the cylinders deflecting too far under drive from these forces, which could prevent the press from operating properly, care is taken to ensure that each cylinder has a relatively small aspect ratio, i.e. that the length of each cylinder between its two end bearing assemblies divided by the diameter of the cylinder remains relatively small, and generally less than about 6.

Thus, the diameters of the cylinders in a press of the above-specified type are relatively large which leads to large weight and to manufacturing and installation costs that are relatively high.

This raises an additional problem for the plate cylinder which, because of its large circumference, makes it necessary either to use plates that are very long and are therefore complex to install, or else to install two plates each corresponding to half the circumference, likewise giving rise to high costs because of the larger number plates that need to be used in a given print run and because of the difficulties involved in installing two plates simultaneously on one plate cylinder.

OBJECTS AND SUMMARY OF THE INVENTION

An object of the invention is to resolve those problems by providing a press of the above-specified type which enables the diameter of at least one cylinder to be reduced and thus enables the cost associated with the press to be reduced.

To this end, the invention provides an offset press of the above-specified type, wherein each of the longitudinal ends of at least a first cylinder are received in first and second bearing assemblies, the second bearing assembly being spaced apart from the first bearing assembly along the longitudinal axis of the first cylinder.

In particular embodiments, the offset press may comprise one or more of the following characteristics taken singly or in any technically feasible combination:

the press comprises off-centering means for each end of the first cylinder for positioning the first bearing assembly eccentrically relative to the second bearing assembly;

the first bearing assembly is movable relative to the frame between a first position in which its eccentricity is reduced or zero, and a second position in which its eccentricity relative to the second bearing assembly is greater, and the off-centering means comprise displacement means for moving the first bearing assembly between its first and second positions;

the first bearing assembly is mounted to pivot relative to the frame about an axis that is substantially parallel to the axis of the second bearing assembly;

the displacement means comprise an actuator extending between the frame and the first bearing assembly;

for each end of the first cylinder, the displacement means are adjustable to enable the first bearing assembly to be moved into a position that is intermediate between its first and second positions;

the first cylinder is the plate cylinder; and the plate cylinder is of diameter smaller than that of the blanket cylinder.

BRIEF DESCRIPTION OF THE DRAWINGS

The invention will be better understood on reading the following description given purely by way of example and made with reference to the accompanying drawings, in which.

MORE DETAILED DESCRIPTION

Figure 1:
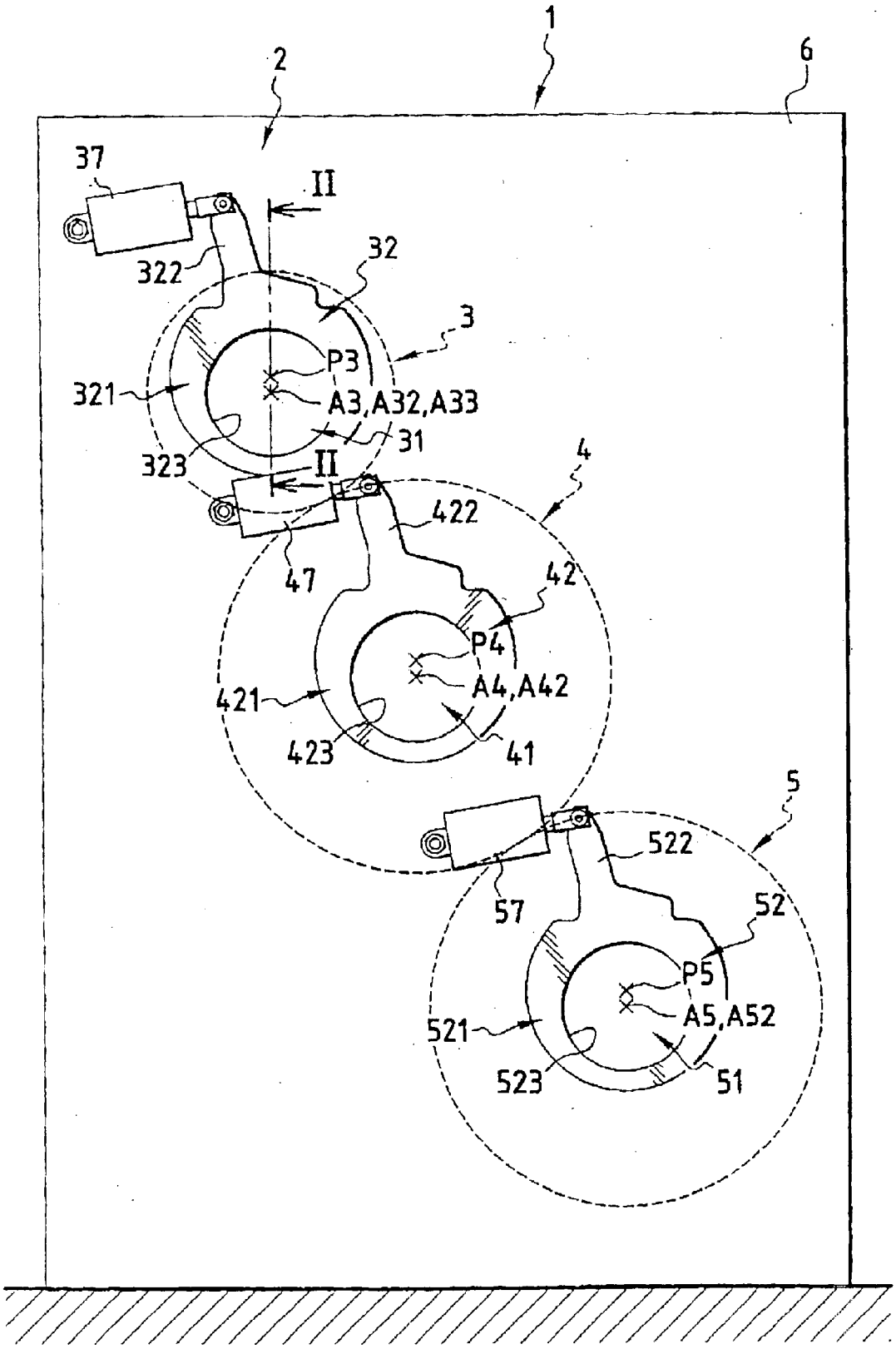
FIG. 1 is a diagrammatic side view of a press of the invention.

FIG. 1 is a diagram showing an offset press 1 essentially comprising a frame 2, a plate cylinder 3, a blanket cylinder 4, and a press cylinder 5.

The blanket cylinder 4 and the press cylinder 5 are of diameter identical to or double that of the plate cylinder 3.

The frame 2 essentially comprises two side uprights 6 in the form of vertical panels, only one of which is visible in FIG. 1. These uprights 6 are placed at opposite ends of the cylinders 3 to 5.

As described below, the cylinders 3 to 5 are rotatably mounted at each of their ends to the uprights 6, each cylinder being free to rotate about a respective longitudinal central axis A3, A4, or A5.

Figure 2:
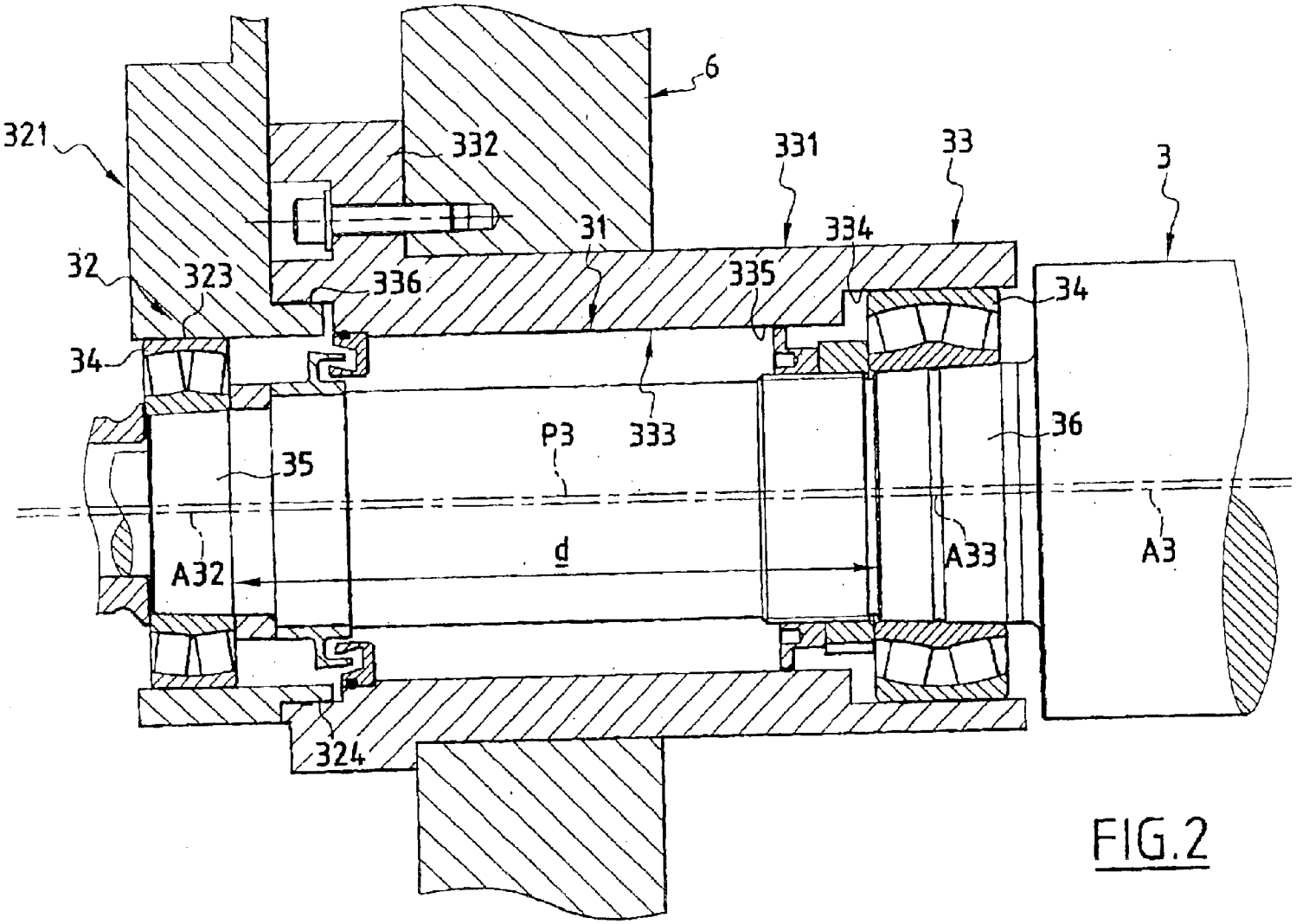
FIG. 2 is a fragmentary diagrammatic section on line II—II of FIG. 1 on a larger scale, this figure showing the bearing assemblies for mounting one end of the plate cylinder to the frame of the FIG. 1 press.

More precisely, and as shown in FIGS. 1 and 2, each longitudinal end 31 of the plate cylinder 3 is rotatably mounted on the corresponding upright 6 via a laterally outer first bearing assembly 32 and a laterally inner second bearing assembly 33.

Since the press 1 is substantially symmetrical about a vertical midplane, only the connection between one end 31 and the frame 2 is described below.

The bearing assemblies 32 and 33 are spaced apart from each other by a non-zero distance d along the longitudinal axis A3 of the plate cylinder 3.

Each of the bearing assemblies 32 and 33 includes a respective rolling bearing 34. The rolling bearing 34 of the assembly 32 bears against a first region 35 of the end 31 in question. The bearing 34 of the assembly 33 bears against a second region 36 of the end 31 in question.

The bearings 34 possess central axes which constitute respectively the axes of the assemblies 32 and 33. These axes are tangential to the axis A3 in the regions 35 and 36 and they are referenced A32 and A33.

It should be observed that the bearings 34 are not shown in FIG. 1 in order to simplify the figure.

As shown in FIG. 2, the second assembly 33 comprises a bushing 331 secured to the corresponding upright 6 via a laterally outer flange 332. The second assembly 33 is thus fixed relative to the frame 2.

The bushing 331 has a stepped bore 333.

This bore 333 comprises a laterally inner segment 334 centered on the axis A3, an intermediate segment 335 likewise centered on the axis A3 but of smaller diameter than the segment 334, and a laterally outer segment 336 of diameter greater than that of the intermediate segment 335 and disposed eccentrically relative to the axis A3. The segment 336 is centered on an axis P3 situated in the same vertical plane as the axis A3 and above it. Typically, the distance between the axis A3 and the axis P3 is 3 millimeters (mm).

The bearing 34 in the second assembly 33 is placed in the inner segment 334 of the bore 333.

The first assembly 32 includes a moving support 321. The support 321 is generally in the form of a circular plane plate centered on the axis P3 and upwardly extended by a drive arm 322.

A circular bore 323 is formed in the support 321. This bore 323 is eccentric relative to the axis P3, the center of the bore 323 being situated substantially on the side of the axis P3 that is opposite from the side on which the arm 322 is situated.

The support 321 is extended laterally inwards by a sleeve 324 received in the laterally outer segment 336 of the bore 333 of the bushing 331 such that the support 321 is capable of pivoting in the bushing 331 about the axis P3.

The bearing 34 in the first assembly 32 is received in the bore 323 of the support 321. The assembly 32 is thus pivotally mounted relative to the frame 2.

The offset press 1 also comprises at each end 31 of the plate cylinder 3 an adjustable displacement actuator 37 having a first end connected to the corresponding upright 6 and an opposite end connected to the arm 322 of the support 321 of the first bearing assembly 32. The actuator 37 is typically a pneumatic actuator.

Figure 3:
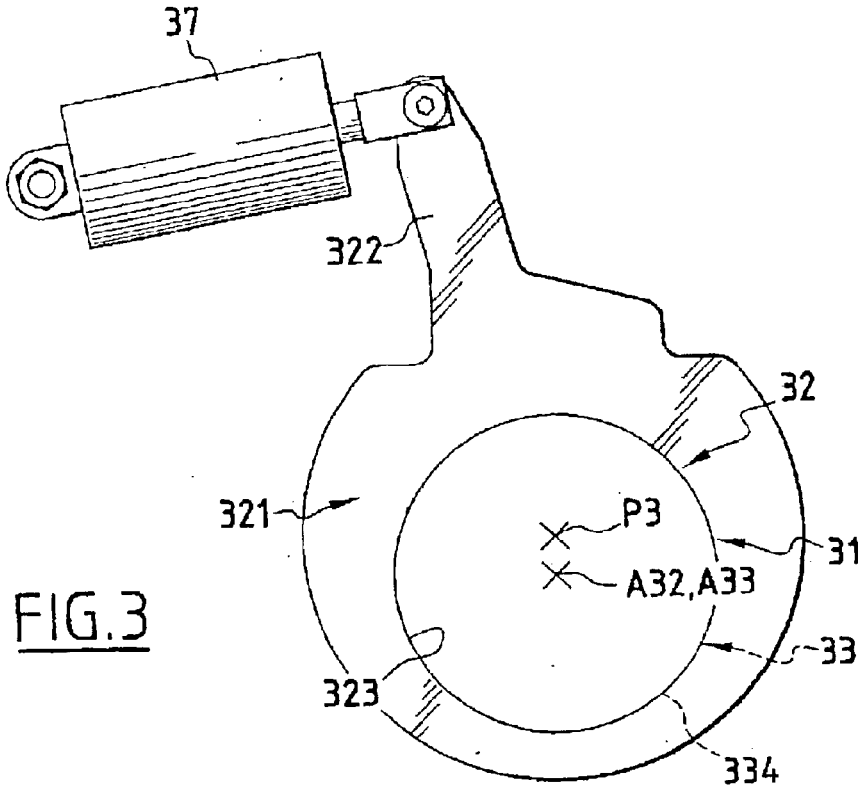
FIG. 3 is a diagrammatic side view on a larger scale showing the FIG. 2 bearing assemblies in a first relative position.
Figure 4:
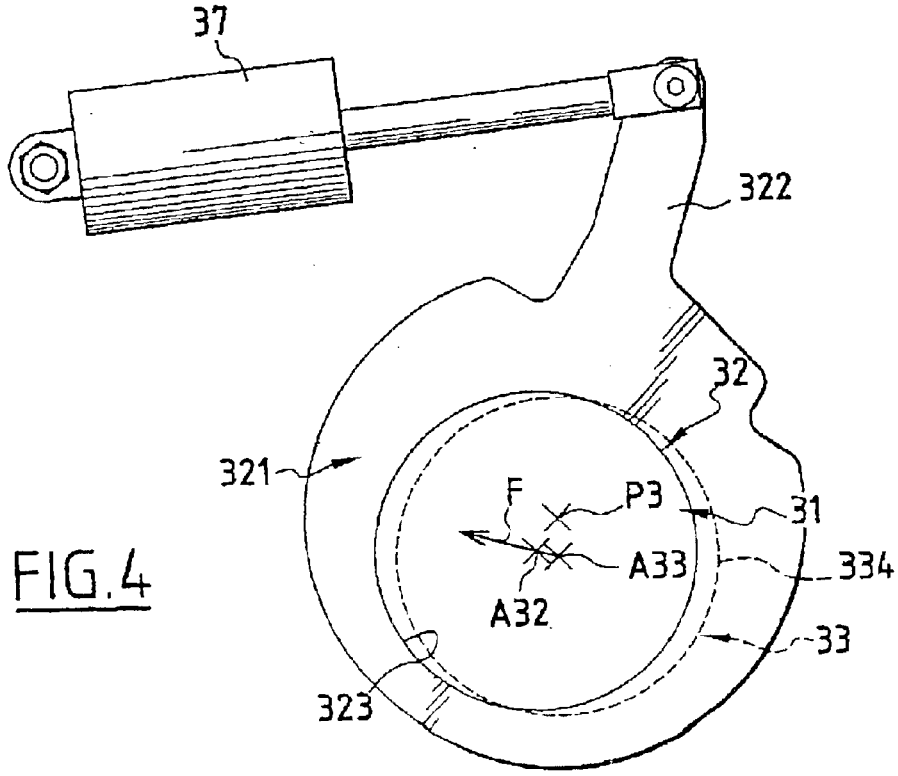
FIG. 4 is a view analogous to FIG. 3, showing a second relative position of the bearing assemblies.

The actuator 37 serves to move the support 321 and thus the first bearing assembly 32 between two positions shown respectively in FIGS. 1 to 3 and in FIG. 4.

In the position of FIGS. 1 to 3, referred to as a "first" position, the axis A32 of the first assembly 32 and the axis A33 of the second assembly 33 coincide.

The first bearing assembly 32 thus possesses zero eccentricity relative to the second bearing blanket 33.

The longitudinal axis A3 of the plate cylinder 3 is thus rectilinear and the plate cylinder 3 is not subjected to any bending stress.

In the position shown in FIG. 4, referred to as the "second" position, the actuator 37 has caused the support 321 to pivot clockwise relative to the frame 2 about the pivot axis P3.

Thus, the axis A32 of the first bearing assembly 32 has pivoted about the axis P3 and no longer coincides with the axis A33 of the second bearing assembly 33.

The axis A32 is thus offset radially relative to the axis A33 substantially in the direction of the bending force F exerted by the blanket cylinder 4 on the plate cylinder 3 when the press 1 is in operation.

The longitudinal axis A3 of the plate cylinder 3 is thus flexed so as to be tangential to the axes A32 and A33 in the corresponding regions 35 and 36 at the ends 31 of the cylinder 3.

Thus, the plate cylinder 3 is prestressed in bending to oppose the force F. The first and second positions of the second bearing assembly 32 are end-of-stroke positions.

It should be observed that in FIGS. 3 and 4, the pivot angle of the support 321 between its two positions and the distances between the axes P3, A33, and A32 are exaggerated in order to show up more clearly.

It should also be observed that the bearings 34 in the assemblies 32 and 33 are omitted from FIGS. 3 and 4 in order to simplify the figures.

As can be seen in FIG. 1, each longitudinal end 41 of the blanket cylinder 4 is mounted to the corresponding upright 6 in the prior art manner by means of a single bearing assembly 42 that is movable relative to the upright 6. The structure of the bearing assembly 42 is analogous to that of an assembly 32 and thus comprises a support 421 mounted to pivot on the corresponding upright 6 about an axis P4. The support 421 is extended by a drive arm 422. The support 421 has a bore 423 on axis A42 that is eccentric relative to the axis P4 and that receives the corresponding end 41 of the blanket cylinder 4. An actuator 47 of adjustable displacement is connected to the upright 6 and to the arm 422 to drive the support 421 to pivot about the axis P4 and thus to move the axis A4 of the cylinder 4 towards or away from the blanket cylinder 3.

Each longitudinal end 51 of the press cylinder 5 is mounted to the corresponding upright 6 in the prior art manner by means of a single bearing assembly 52 that is movable relative to the upright 6. This assembly 52 is analogous in structure to an assembly 32 and thus comprises a support 521 pivotally mounted on the corresponding upright to pivot about an axis PS. The support 521 is extended by a drive arm 522. The support 521 presents a bore 523 on an axis A52 that is eccentric relative to the axis P5 and it receives the corresponding end 51 of the press cylinder 5. An actuator 57 of adjustable displacement is connected to the upright 6 and to the arm 522 to drive the support 521 to pivot about the axis P5 and thus to move the axis A5 of the cylinder 5 towards or away from the blanket cylinder 4.

Finally, the press 1 has conventional means (not shown) for rotating the cylinders 3 to 5 about their respective axes A3 to A5.

In order to use the press 1, the moving bearing assemblies 42 and 52 are used to move the corresponding longitudinal axes A4 and A5 of the cylinders 4 and 5 so as to position them relative to the axis A3 in such a manner as to enable ink to be transferred in satisfactory manner from the plate carried by the cylinder 3 to the blanket carried by the cylinder 4 and on to the paper for printing as it passes between the cylinders 4 and 5.

Such relative positioning is entirely conventional for the person skilled in the art and is therefore not described in greater detail.

Prior to this positioning, the first bearing assemblies 32 of the plate cylinder 3 are moved from their first position towards their second position or towards some intermediate position under drive from the actuators 37.

The cylinder 3 thus flexes as described above. In this way, when the blanket cylinder 4 is pressed against the plate cylinder 3 in order to transfer ink in satisfactory manner, the bending force F applied by the blanket cylinder 4 against the plate cylinder 3 is compensated by the prestress of the plate cylinder 3 created by the first bearing assemblies 32 being eccentric relative to the second bearing assemblies 33.

Thus, the overall deformation of the cylinder 3 while the offset press 1 is in operation, e.g. as measured by the deformation displacement of the cylinder 3 is caused to be particularly small. As a result the diameter of the cylinder 3 and thus its associated weight and cost can be reduced.

By using adjustable actuators 37, the amount of prestress applied to the cylinder 3 can be adjusted to an acceptable value by placing the bearing assemblies 32 in positions that are intermediate between their first and second positions.

In reality, the bending of the plate cylinder 3 is limited firstly because of the presence of two longitudinally spaced-apart bearing assemblies 32 and 33 at each end 31 of the plate cylinder 3, and secondly because of the two bearing assemblies 32 and 33 being mutually eccentric when the press 1 is in operation.

It should be observed that the first of these characteristics can be used alone in order to limit bending of the plate cylinder 3.

It has thus been found that under identical operating conditions, using two end bearing assemblies that are fixed and longitudinally spaced apart serves to halve the deformation deflection of the plate cylinder 3.

More generally, the above principles can be applied separately or otherwise to each of the cylinders 3, 4, and 5 of the offset press 1 in order to reduce their respective diameters, even though they are particularly advantageous for the plate cylinder 3 since they then avoid problems associated with mounting plates of large dimensions or with mounting two plates simultaneously.

Thus, the diameters of the cylinders 4 and 5 can also be reduced independently or otherwise of the diameter of the cylinder 3.

What is claimed is:

1. An offset press of the type comprising a frame, at least one plate cylinder, a press cylinder, and a blanket cylinder interposed between the plate cylinder and the press cylinder, and bearing assemblies carried by the frame and receiving the longitudinal ends of the cylinders so that each cylinder is rotatable relative to the frame about a respective longitudinal central axis, wherein each of the longitudinal ends of at least a first cylinder of said plate, press, and blanket cylinders is received in first and second bearing assemblies carried by the frame whereby the longitudinal ends of the first cylinder are rotatable in the first and second bearing assemblies with respect to the frame, the second bearing assembly being spaced apart from the first bearing assembly along the longitudinal axis of the first cylinder, the offset press further including off-centering means for each end of the first cylinder adapted to position the first bearing assembly eccentrically relative to the second bearing assembly, wherein the first bearing assembly is movable relative to the frame between a first position in which its eccentricity relative to the second bearing assembly is reduced or zero, and a second position in which its eccentricity relative to the second bearing assembly is greater, and wherein the off-centering means comprise displacement means for moving the first bearing assembly between its first and second positions.

2. A press according to claim 1, wherein the first bearing assembly is mounted to pivot relative to the frame about an axis that is substantially parallel to the axis of the second bearing assembly.

3. A press according to claim 1, wherein the displacement means comprise an actuator extending between the frame and the first bearing assembly.

4. A press according to claim 1, wherein, for each end of the first cylinder, the displacement means are adjustable to enable the first bearing assembly to be moved into a position that is intermediate between its first and second positions.

5. A press according to claim 1, wherein the first cylinder is a plate cylinder.

6. A press according to claim 5, wherein the plate cylinder is of a diameter smaller than that of the blanket cylinder.

* * * * *